US006875019B2

(12) United States Patent
Huang et al.

(10) Patent No.: US 6,875,019 B2
(45) Date of Patent: Apr. 5, 2005

(54) NAVAL VIRTUAL TARGET RANGE SYSTEM

(75) Inventors: Paul C. Huang, Circle Pines, MN (US); Norman S. Scott, Issue, MD (US); Omar A. Khan, Minneapolis, MN (US); Albert Sleder, Jr., Eagan, MN (US); David C. Heim, Andover, MN (US)

(73) Assignee: United Defense, LP, Arlington, VA (US)

( * ) Notice: Subject to any disclaimer, the term of this patent is extended or adjusted under 35 U.S.C. 154(b) by 0 days.

(21) Appl. No.: 10/073,666

(22) Filed: Feb. 11, 2002

(65) Prior Publication Data

US 2003/0152892 A1 Aug. 14, 2003

(51) Int. Cl.[7] ..... G09B 19/00

(52) U.S. Cl. ..... 434/14; 434/11; 434/12; 434/16

(58) Field of Search ..... 434/11, 12, 14, 434/16, 25, 27

(56) References Cited

U.S. PATENT DOCUMENTS

| | | | | |
|---|---|---|---|---|
| 3,522,667 | A | | 8/1970 | Guillenchmidt et al. |
| 3,629,959 | A | | 12/1971 | Colin et al. |
| 4,232,456 | A | | 11/1980 | Harmon et al. |
| 4,290,757 | A | | 9/1981 | Marshall et al. |
| 4,308,015 | A | * | 12/1981 | Tye ..... 434/14 |
| 4,439,156 | A | | 3/1984 | Marshall et al. |
| 4,534,735 | A | | 8/1985 | Allard et al. |
| 4,538,991 | A | | 9/1985 | Simpson et al. |
| 4,552,533 | A | | 11/1985 | Walmsley |
| 4,705,477 | A | | 11/1987 | Komorowski et al. |
| 4,813,877 | A | | 3/1989 | Sanctuary et al. |
| 5,095,433 | A | | 3/1992 | Botarelli et al. |
| 5,224,860 | A | | 7/1993 | Waldman et al. |
| 5,281,142 | A | | 1/1994 | Zaenglein, Jr. |
| 5,292,254 | A | | 3/1994 | Miller et al. |
| 5,415,548 | A | | 5/1995 | Adams |
| 5,551,876 | A | | 9/1996 | Koresawa et al. |
| H1618 | H | * | 12/1996 | Blume ..... 367/5 |
| 5,676,548 | A | | 10/1997 | McAlpin et al. |
| 5,677,841 | A | * | 10/1997 | Shiomi et al. ..... 701/120 |
| 5,786,849 | A | * | 7/1998 | Lynde ..... 348/113 |
| 5,892,462 | A | * | 4/1999 | Tran ..... 340/961 |
| 5,960,097 | A | * | 9/1999 | Pfeiffer et al. ..... 382/103 |
| 6,106,297 | A | * | 8/2000 | Pollak et al. ..... 434/16 |
| 6,283,756 | B1 | * | 9/2001 | Danckwerth et al. ..... 434/11 |
| 6,296,486 | B1 | | 10/2001 | Cardaillac et al. |

* cited by examiner

*Primary Examiner*—Derris H. Banks
*Assistant Examiner*—John Sotomayor
(74) *Attorney, Agent, or Firm*—Patterson, Thuente, Skaar & Christensen, P.A.

(57) ABSTRACT

An integrable naval virtual target range system and method provides three-dimensional graphical viewing capabilities of a virtual target range so that naval and fire support personnel can train together during both simulated and live fire exercises. The virtual target range system comprises a control subsystem having a computer system and a spotter subsystem for monitoring virtual impact points on the virtual target range. The target system may further comprise a buoy subsystem and/or an aerial vehicle subsystem, for use during live fire exercises, to locate ordnance impact points used for calculating the virtual impact points.

23 Claims, 12 Drawing Sheets

NAVAL VIRTUAL TARGET RANGE SYSTEM

FIELD OF THE INVENTION

The present invention relates to training naval and fire support personnel how to use actual naval weapon systems hardware under conditions of simulated or live fire exercises. In particular, the present invention relates to a system and method that can be integrated to work with and train naval and fire support personnel on actual naval weapon systems hardware by implementing a naval virtual target range and calculating results of the naval weapon system simulated or live fire exercises.

BACKGROUND OF THE INVENTION

Modem armament systems for military applications are increasingly more lethal and require more training for operators to be proficient in their use. Training operators can be accomplished by live fire exercises or simulated fire exercises. Wholly simulated fire exercises, however, often lack fidelity, whereas live fire exercises onto real target ranges require special and costly facilities and precautions. Moreover, live fire exercises onto many real target ranges have become more controversial. For example, use of Vieques Island and Hawaii as target ranges by the United States Navy has become politically unpopular, and the United States Federal Government has been compelled to withhold permission for all live fire exercises by the Navy at these sites.

Without an adequate substitute for wholly simulated fire exercises and by indefinitely closing target ranges to live fire exercises, the combat readiness of naval forces can be seriously impaired and a country's national defenses weakened. Thus, alternatives must be developed for naval preparedness. Appropriate to selecting alternative naval target ranges are concerns about using a populated island as a naval target range, the impact of such use on a regional ecosystem, other costs associated with such use, and locating an adequate environment for training personnel to operate naval weapon systems. Moreover, because the nature of naval fire exercises involves firing ordnance from very large caliber guns for long distances from a position in a body of water, many target range concepts are inadequate for use as naval target ranges.

E. Cardaillac et al., U.S. Pat. No. 6,296,486, Missile Firing Simulator with the Gunner Immersed in a Virtual Space, describes a simulator for firing weapons and includes a firing station and a missile weapon simulator. The simulator is a closed system primarily for shoulder held or tripod missile launchers for training users without using real projectiles or missiles. The firing station comprises a display device that can be a standard video screen or a large screen. The simulator does not accommodate a spotter because the simulator is designed for small-scale weapon systems. P. Wescott, U.S. Pat. No. 4,820,161, Training Aid, describes an apparatus for simulating artillery. It too is a closed system having a projection screen for displaying an image. Computer generated artillery shell bursts are overlaid on a photographic image of terrain by a video projector at locations commanded by a trainee observer.

A myriad of target range systems having sensors have been developed so that virtual targets can be displayed and fired upon from a given location. Examples are C. Sanctuary et al., U.S. Pat. No. 4,813,877, Remote Strafe Scoring System; V. Botarelli et al., U.S. Pat. No. 5,095,433, Target Reporting System; W. Zaenglein, Jr., U.S. Pat. No. 5,281, 142, Shooting Simulating Process and Training Device; S. Koresawa et al., U.S. Pat. No. 5,551,876, Target Practice Apparatus; D. Downing, U.S. Pat. No. 5,577,733, Targeting System; and J. McAlpin et al., U.S. Pat. No. 5,676,548, Apparatus for Target Practice. Almost all of these describe apparatus for small arms or small weapon systems firing, and many of them are closed systems. Consequently, they implement target ranges by projections onto plates, sheets, and screens. Sensors are used to provide computer systems with data to locate impact points, which sensors span a variety of types, from light panels to acoustic sensors to pressure sensitive sensors. Like the simulators cited above, they do not accommodate a spotter.

One "hardware-in-the-loop" simulator is described by G. Waldman et al., U.S. Pat. No. 5,224,860, Hardware in the Loop Tow Missile System Simulator. The system is specific to TOW missile systems, wherein a simulation module creates a battlefield environment including at least one moveable target. Another system, described in R. Adams, U.S. Pat. No. 5,415,548, System and Method for Simulating Targets for Testing Missiles and Other Target Driven Devices, has both a background memory and a target memory and overlaps selected frames from the target memory onto the selected background to create a virtual target. This information is input into a missile or other target driven device to indicate the presence and position of the target and to test the responsiveness of the device.

The United States Navy has experimented with solutions of its own. One solution uses a flat view of a simulated island on weapon system displays as a virtual target range to support live fire exercises. This kind of simulation has been used at the United States Naval Pacific Missile Range Facility at Barking Sands in Kauai, Hawaii. This facility uses an array of fixed survey buoys anchored at predetermined offshore locations. A graphic of an island (topographic map) is then "overlaid" onto the buoys' global coordinates on a map or display, and naval weapon systems are directed to fire at particular locations on the virtual island. Sensor on the buoys record the impacts of rounds on the water. The sensor data for each buoy includes a timestamp and location of the respective buoy, and is communicated back to a central processing station where the data is used to compute the trajectory of a round and the impact point of the round. From this information, a virtual impact point with respect to the previously implemented, flat virtual target range is calculated and overlain onto the target range. Another example is the Potomac River Test Range of the United States Naval Surface Weapon Center Dahlgren Division. This facility superimposes a flat image of the north end of San Clemente Island over an impact area defined on the Potomac River using an IMPASS buoy system where by each buoy is free-floating and equipped with a hydro-phonic sensor and global positioning system.

The virtual target range systems described above use a set of buoys and a computer system to sense, analyze, and calculate impact points of naval weapon system fire exercises. Sensors on the fixed buoys record the impact points of live fire exercises on the water, from which the virtual impact points on virtual target ranges are calculated. Installing these buoys, however, is costly and they require regular maintenance. Also, anchoring buoys in deep-sea locations requires special technical training and safety precautions. Free floating buoys can be used in the open ocean, but deploying and recovering these kinds of buoys also has problems, such as requiring additional manpower and managing the associated risks and time delays.

Moreover, most current virtual target range systems are used primarily for testing delivery accuracy of weapon systems, but not for training spotters or survey teams. Current systems are based on the assumption that spotters will need tele-presence. Consequently, spotters still use visual contact to acquire a surface water impact on a range. They cannot make adjustments to a fire exercise since they only see surface water and not a virtual target range. In addition, fixed buoys have to be pre-installed at specific locations. Ships thus may have to sail thousands of miles to those locations for training. Finally, and most importantly, the systems discussed above do not provide the flexibility of anywhere-anytime simulation and training.

SUMMARY OF THE INVENTION

An integrable naval virtual target range system and method provides three-dimensional graphical viewing capabilities of a virtual target range so that naval and fire support personnel can train together during both simulated and live fire exercises. The virtual target range system comprises a control subsystem having a computer system and a spotter subsystem for monitoring virtual impact points on the virtual target range. The target system may further comprise a buoy subsystem and/or an aerial subsystem, for use during live fire exercises, to locate ordnance impact points used for calculating virtual impact points.

The naval virtual target range system and method allow a survey team and other weapons system personnel to train in a realistic or hardware-in-the-loop environment, whether or not the exercise is conducted with live or simulated fire. The system is constructed of low cost, commercially off-the-shelf components, so that future maintenance and system upgrades are easy to make, and is versatile, so that it can be integrated to work with various weapons configurations. Finally, the system provides an acceptable approach to fulfilling these objectives while addressing concerns of both the civilian and military communities.

Preferred embodiments of the present invention provide naval forces with a versatile weapon systems training environment. The target system can be added onto, be built into, or be independent of a naval weapon system. The naval virtual target range system comprises a control subsystem or central processing subsystem, which subsystem includes a computer system, and a monitor or spotter subsystem. The naval virtual target range system can further comprise a buoy subsystem, an aerial subsystem, or both, both of which are sensory subsystems. These subsystems can be positioned at different locations and on different platforms, such as a ship, or positioned on a single platform. The target system can be used to perform live, simulated, or a combination of live and simulated fire exercises and to score the fire exercises. Either one or a combination of the sensory subsystems can be used to provide data to the control subsystem for evaluating a live fire exercise. The target system is built using commercially available off-the-shelf components, and the overall system can be upgraded and maintained by most engineering facilities.

The target system can be used for simulated fire while a ship is in a harbor or dockside, or for simulated or live fire during a voyage or in a designated target area. The target system thus allows for anytime-anywhere training and minimizes or eliminates travel to and from a training facility. To maximize training efficiency, the target system can use available terrain databases to implement life-like, virtual, three-dimensional graphical views of geographic formations, such as virtual islands or virtual coastline, and can use available databases of physical objects to implement three-dimensional views of targets to be overlain on the geographic formations. By enabling three-dimensional graphical views of virtual target ranges, the target system can more accurately calculate results of a fire exercise and can be used to effectively train spotters as well as other naval personnel in a near realistic environment.

A preferred embodiment of the naval virtual target system includes a control subsystem and a spotter subsystem. The control subsystem is operatively connected to a naval weapon system and has a computer system for implementing a three-dimensional graphical view of a naval virtual target range for use in conjunction with a naval weapon system fire exercise and for calculating results of the naval weapon system fire exercise from selective data provided by the naval weapon system. The spotter subsystem is operatively connected to the control subsystem and has a display for viewing three-dimensional results in still or animated form of the naval weapon system fire exercise. A preferred embodiment may also include a buoy subsystem having a global positioning system and at least three sensors for determining the impact points of a naval weapon system fire exercise relative to the buoy subsystem. The buoy subsystem is operatively connected to the control subsystem also to provide data thereto.

Another preferred embodiment comprises a control subsystem as described above and an aerial subsystem. This aerial subsystem includes an aerial vehicle that may be manned or unmanned. The aerial vehicle is capable of determining its own global position and has either a camera system or millimeter-wave radar, or both, for determining the impact points of a naval weapon system fire exercise relative to the aerial vehicle. The aerial vehicle is operatively connected to the control subsystem also to provide data thereto.

DESCRIPTION OF THE PREFERRED EMBODIMENT

Figure 1:
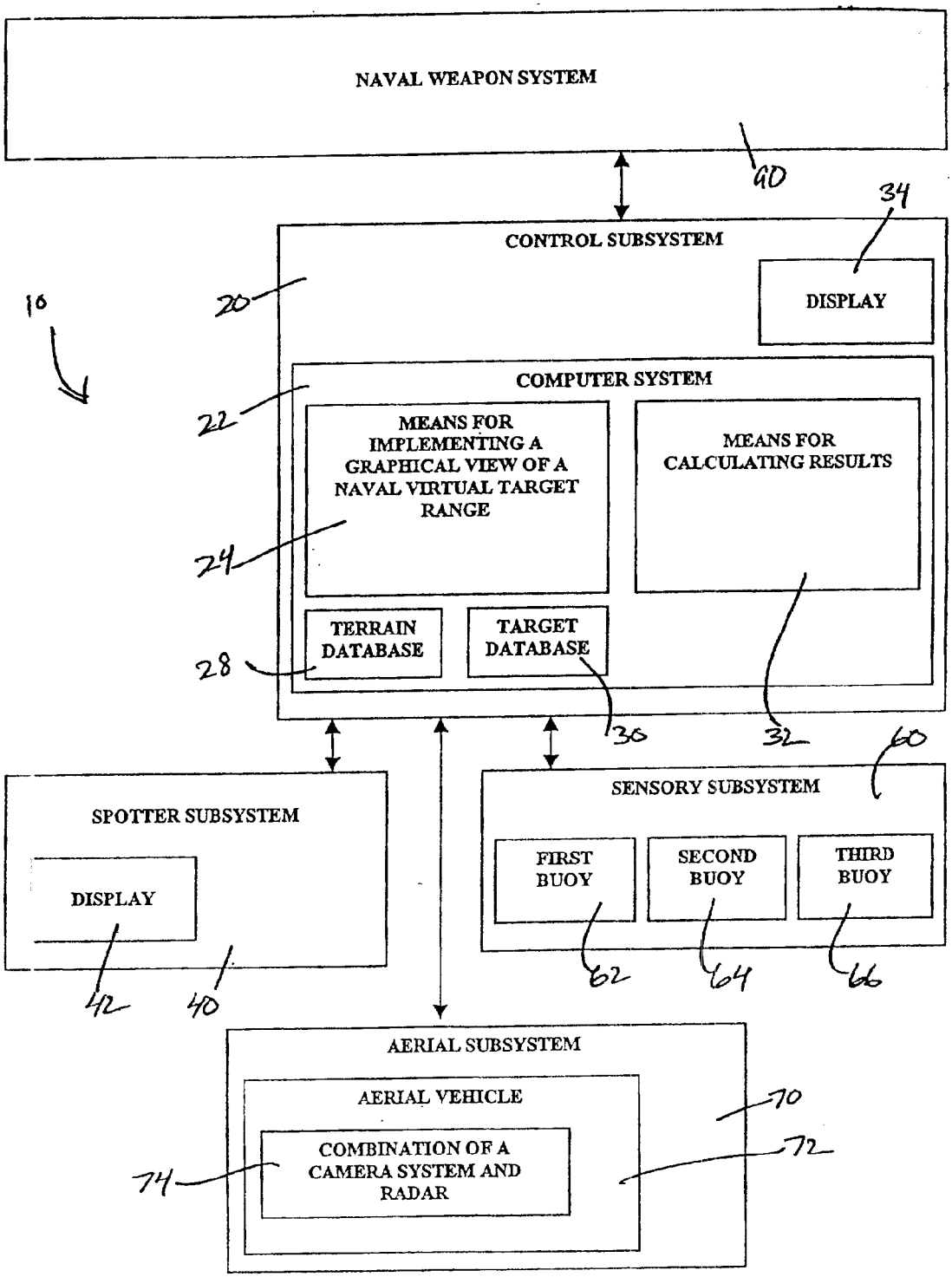
FIG. 1 is a diagram illustrating the naval target range system.

The preferred embodiment relates to an integrable naval virtual target range system in accordance with the present invention. FIG. 1 is a diagram illustrating the general configuration of the naval virtual target range system or target system 10. The target system 10 can be added onto, be built into, or be independent of a naval weapon system 90. The preferred embodiment is comprised of a control subsystem 20, a spotter subsystem 40, and a buoy subsystem 60. The target system 10 also may further comprise an aerial subsystem 70 including an unmanned aerial vehicle 72, to be used alternatively to or in combination with the buoy subsystem 60. The various subsystems of the target system 10 can be positioned at different locations and on different platforms, such as a ship, or positioned on a single platform. Preferably, the control subsystem or central processing subsystem 20 is located on board the ship having the naval weapon system 90 and participating in a naval weapon system fire exercise, the buoy subsystem 60 is located in the waters upon which a naval virtual target range 26 (not shown) is to be superimposed by the control subsystem 20, and the unmanned aerial vehicle 72 is launched from the ship participating in the fire exercise or from a platform nearer the virtual target range 26. The target system 10 supports both live and simulated fire or a combination of these and can score fire exercises; it 10 is used to implement "over water" virtual target ranges during live fire exercises, is built using commercially available off-the-shelf components, and can be upgraded and maintained by most engineering facilities.

Figure 2:
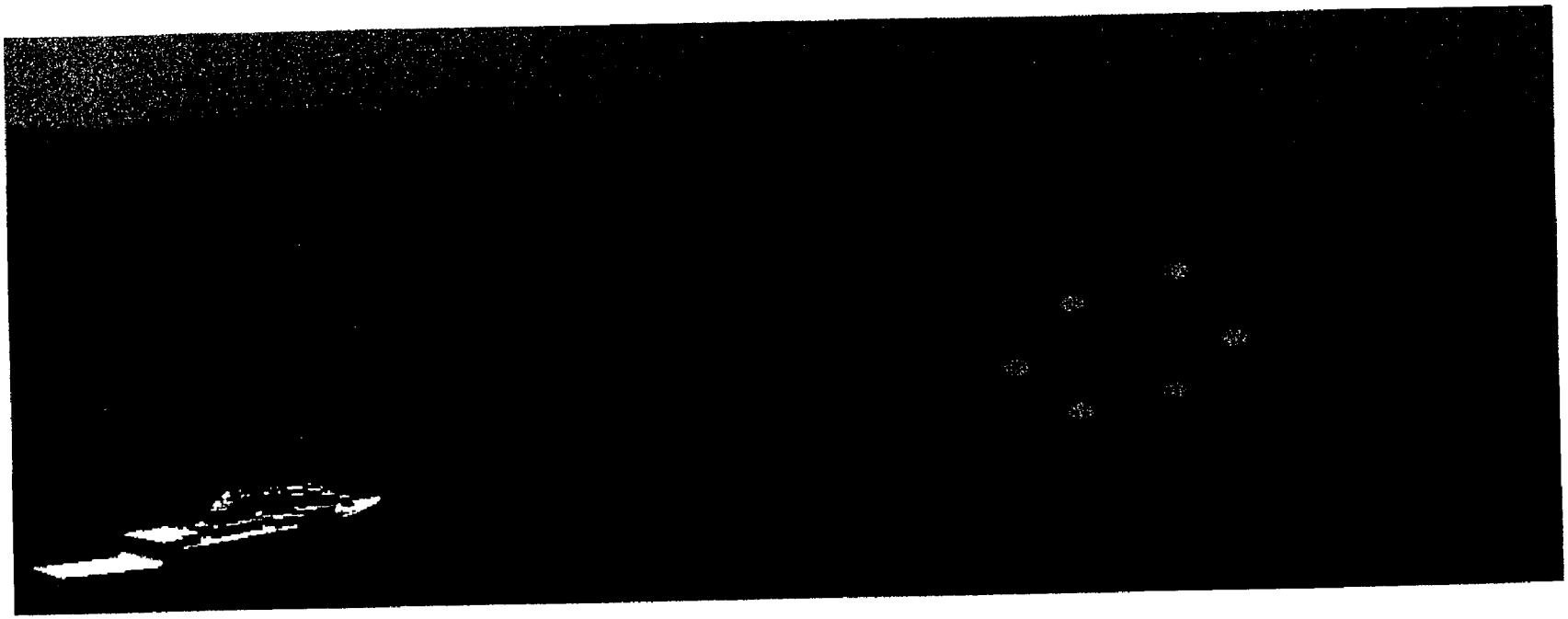
FIG. 2 is a depiction of a computed trajectory for a fire exercise upon a naval virtual target range.
Figure 2A:
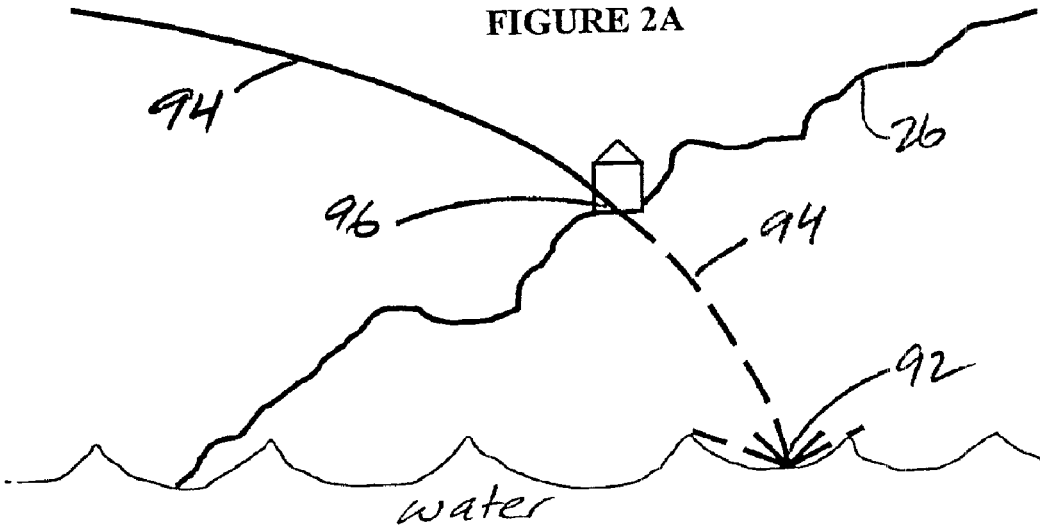
FIG. 2A is a cross-sectional side view of a trajectory of ordnance launched during a naval fire exercise.

The control subsystem 20 is mobile and includes a computer system 22, which further includes a stored computer program for implementing a graphical view 24 of a naval virtual target range, a terrain database 28, a target database 30, and a stored computer program for calculating results 32 of naval fire exercises. The control subsystem 20 also includes a transmitter-receiver, preprocessor unit for receiving data and images from the sensory subsystems, a global positioning system, a main processor, a controller, and at least one control subsystem display 34. The control subsystem 20 is operatively connected to the naval weapon system 90 to create a hardware-in-the-loop training environment. The terrain database 28 is a governmentally or commercially available, digital database, as is the target database 30. The terrain database 28 is used to implement virtual, three-dimensional graphical views of geographic formations, such as virtual islands or virtual coastlines, while the target database 30 is used to implement virtual, three-dimensional graphical views of physical objects, such as buildings, vehicles, or weapon systems, as targets to be overlain on the views of the geographic formations. The consolidated view is implemented using the graphical view computer program 24 developed from standard computer graphics software programming techniques known to those skilled in the art of computer graphics, and is then overlain onto a map view on a spotter subsystem display 42 and a control subsystem display 34. The computer program for calculating results 32 of and evaluating a naval weapon system fire exercise uses data communicated from the naval weapon system 90 during simulated fire exercises and from the naval weapon system 90 and the buoy subsystem 60 and/or unmanned aerial vehicle 72 during live fire exercises. As shown in FIGS. 2 and 2A, this data is used as input for finding and mapping the impact points 92 of a fire exercise, which locations are used to derive trajectories 94 of the ordnance and virtual impact points 96 on the previously implemented naval virtual target range 26. These virtual impact points 96 are then overlain on the virtual target range 26.

The spotter subsystem 40 includes a transmitter-receiver, global positioning system, and the spotter subsystem display 42 for viewing a three-dimensional graphical view of a naval virtual target range 26. The spotter subsystem 40 is operatively connected to the control subsystem 20 so that spotters can be trained as part of a naval weapon system fire exercise concurrently and interactively with other naval personnel.

The buoy subsystem 60 includes at least three floating buoys, a first buoy 62, a second buoy 64, and a third buoy 66, which buoys may be free floating or fixed. The floating buoys are each equipped with global positioning systems and with radar, acoustic sensors, or both. Each buoy also has a transmitter and a power supply and is operatively connected to the control subsystem 20. To map the location of an impact point, suppose at a given time $t_0$, a buoy, assume first buoy 62, records an impact sound of a fire exercise and the location of first buoy 62 as $(x_1, y_1)$ in a rectangular coordinate system of the virtual target range 26. Assume second buoy 64 records the impact sound at time $t_0+dt_1$ and the location of second buoy 64 as $(x_2, y_2)$. Further assume that third buoy records the impact sound at time $t_0+dt_2$ and its 66 location as $(x_3, y_3)$. Assuming that the coordinates of the impact point are (x, y), to compute the value of x and y, the following simultaneous equations are solved by running the computer program for calculating results 32:

$$(x-x_1)^2+(y-y_1)^2=l^2,$$

$$(x-x_2)^2+(y-y_2)^2=(l+l_1)^2, \text{ and}$$

$$(x-x_3)^2+(y-y_3)^2=(l+l_2)^2.$$

Here, $l_1=dt_1*s$ and $l_2=dt_2*s$, where l is the distance from the impact point to first buoy 62, and s is the speed of the sound, given the ambient conditions of the fire exercise.

Figure 3:
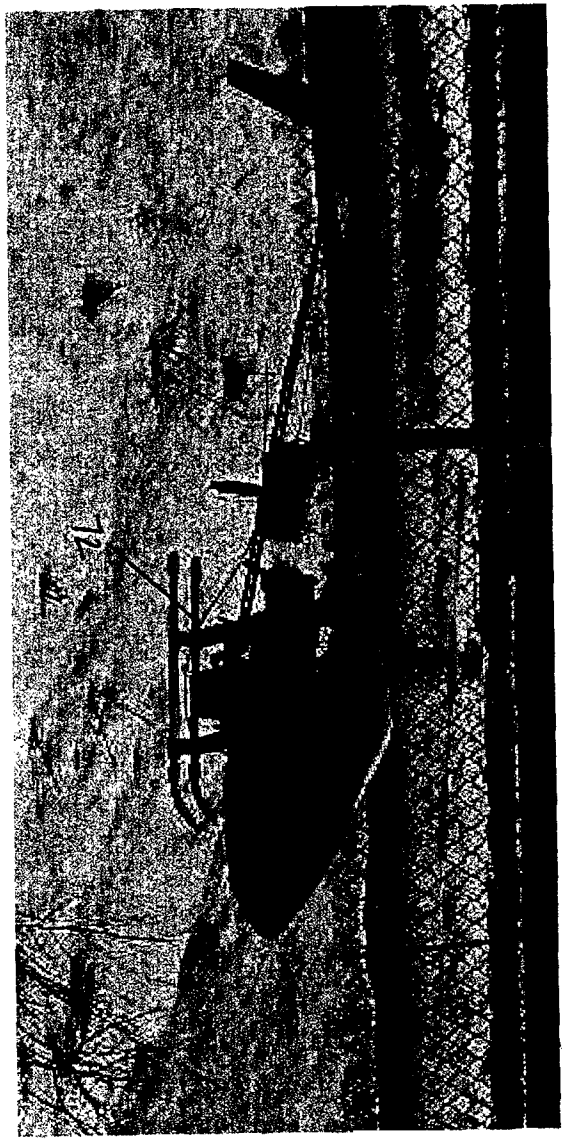
FIG. 3 is a depiction of an unmanned aerial vehicle.
Figure 4:
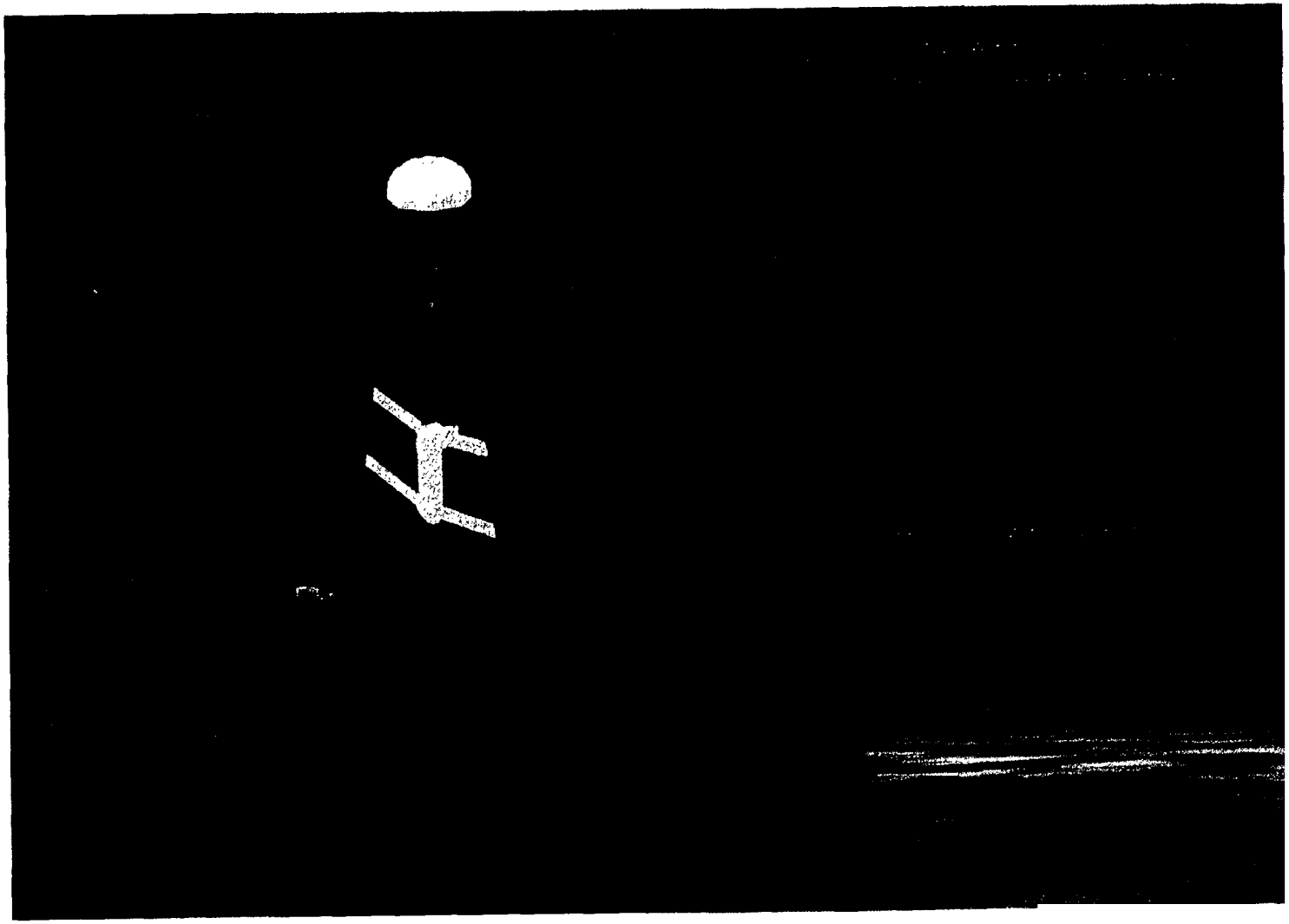
FIG. 4 is a depiction of various camera views from an aerial vehicle.

The preferred embodiment of the unmanned aerial vehicle (UAV) 72 is illustrated in FIG. 3 as an unmanned helicopter, although those skilled in the art are aware of other vehicles that may float, drift from, glide, or fly aloft. An aerial vehicle 72 is equipped with one or a combination of charged-coupled device (CCD) cameras, digital television (DTV), infrared (IR) cameras, and millimeter-wave (mmW) radar 74 for continuous video and/or radar monitoring. The preferred embodiment uses a plurality of digital televisions, which work best in good weather conditions and are relatively inexpensive. Preferably, a plurality of cameras are used to get views from different angles, such as a forward view and a downward view, as shown in FIG. 4. The aerial vehicle 72 also includes a transmitter-receiver (TX/RX), differential global positioning system (DGPS), power supply, and unmanned aerial vehicle controller and is operatively connected to the control subsystem 20 to provide visual data, global positioning data, and position orientation data. When millimeter-wave radar is used as a sensor, it operates in a manner similar to a camera system. To use a camera system of the aerial vehicle 72, a camera view is assumed to be a "rectangular" view forming a mathematical "plane". In the rectangular coordinate system of this mathematical plane, each line in the space is associated with a directional number (see Standard Mathematical Tables, $22^{nd}$ edition, CRC Press, 1974). From the camera view, each point on the view plane corresponds to a point on the surface of the water. This point on the surface, when linked to the center of the camera, associates with a line, and hence, a directional number.

Camera views are first sent to buffers in the computer system 22 so that a frame-by-frame comparison can be made between consecutive frames. This comparison involves searching the frames for significant changes, i.e., changes that remain after the frames are run through a series of digital filters to remove signal noise. If such a change is found, one of many commercially available off-the-shelf image processing software packages is used to identify the change. The well-known Robert Operator, for example, uses gray scales to draw outlines of objects in a video view and is simple and effective for automatically locating an impact point on open water. Usually this object is an ellipse caused by water rippling outwardly from the impact point. By finding the major axis of the ellipse, the center of the ellipse can be determined, which ought to approximate the impact point. To simplify the algorithm for mapping the impact point, assume that ($a_0$, $b_0$, $c_0$) is the directional number of the centerline of a camera at the time an impact point appears on the view. Further assume that the coordinate of the center point is ($x_c$, $y_c$, $z_c$), the directional number of the impact point on the surface of the water is ($a_1$, $b_1$, $c_1$), and the coordinate of the impact point is (x, y, z). To further simplify the computation, assume that the surface water level has zero height and thus z equals zero. To calculate the coordinate of the impact point, the following system of simultaneous equations is solved by the program for calculating results 32:

$$(x-x_c)/a_1=(y-y_c)/b_1=-z_c/c_1.$$

Using the impact point on the water, a trajectory of the ordnance can be derived by the control subsystem 20. The intersection of the trajectory, a space curve, with the virtual geographic formation, a three dimensional surface, selected for the virtual target range 26 is then determined and compared with the location of targets, from which appropriate information can be generated regarding a direct hit, an effective kill, a percentage kill, or a miss. Using this information, three-dimensional results in still or animated form can be displayed on the spotter subsystem display 42 and on the control subsystem display 34 for near-realistic effect.

The naval virtual target range system 10 also supports a wholly simulated naval weapon system fire exercise. In simulation mode, a naval ordnance launching is simulated as well as information such as trajectory projection, impact point calculation, buoy subsystem and/or aerial vehicle functioning, and effects on a virtual target range. This functionality gives the naval virtual target range system 10 its anytime-anywhere capability. This capability facilitates training without informing those who should not know and facilitates training personnel independently or as a team without interruption. Moreover, by using the naval virtual target range system 10 shortly before an operation, all related personnel can use the terrain database of the actual targets to perform intensive training.

Figure 5:
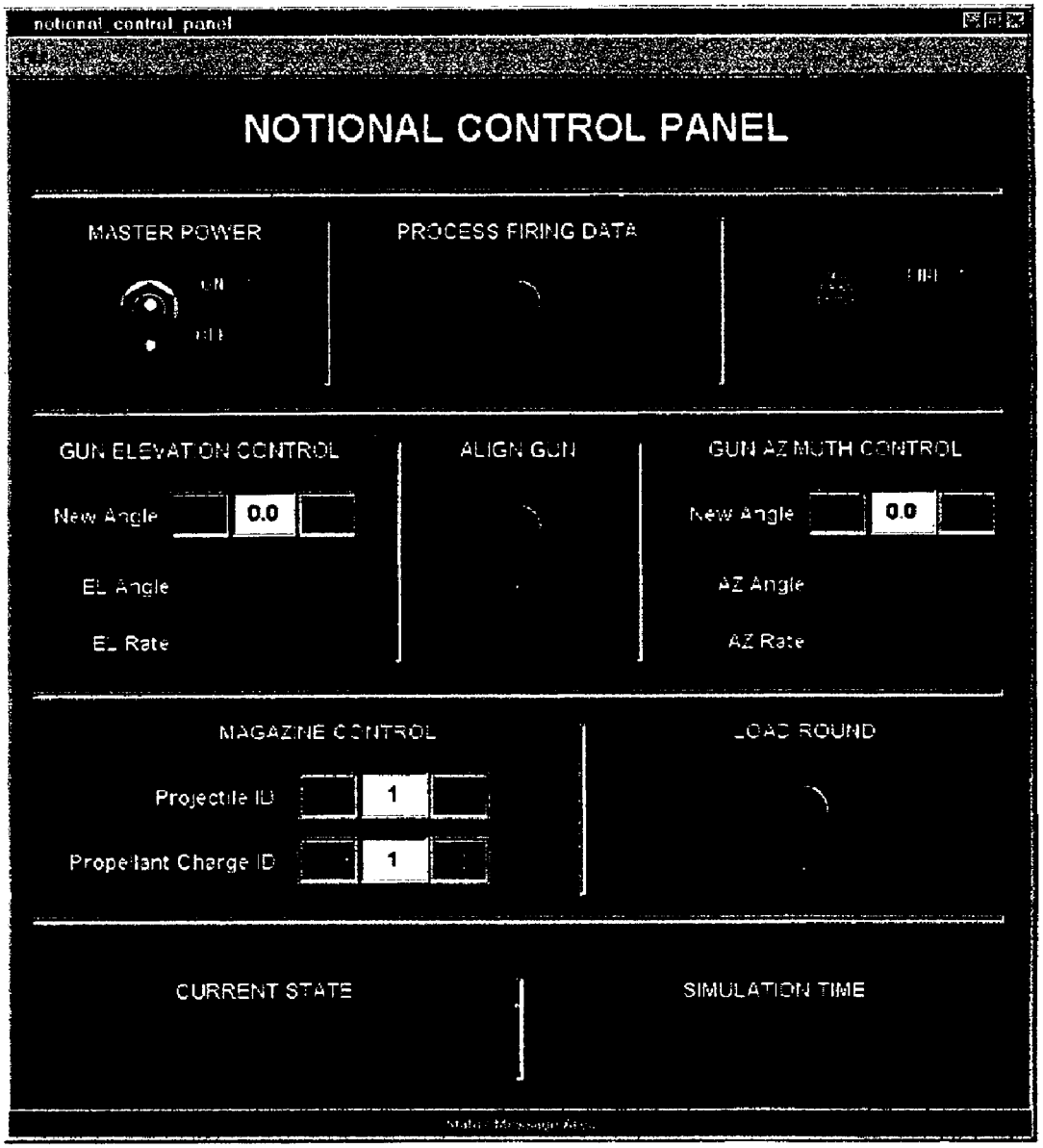
FIG. 5 is a depiction of a generic control panel for the target system.
Figure 6:
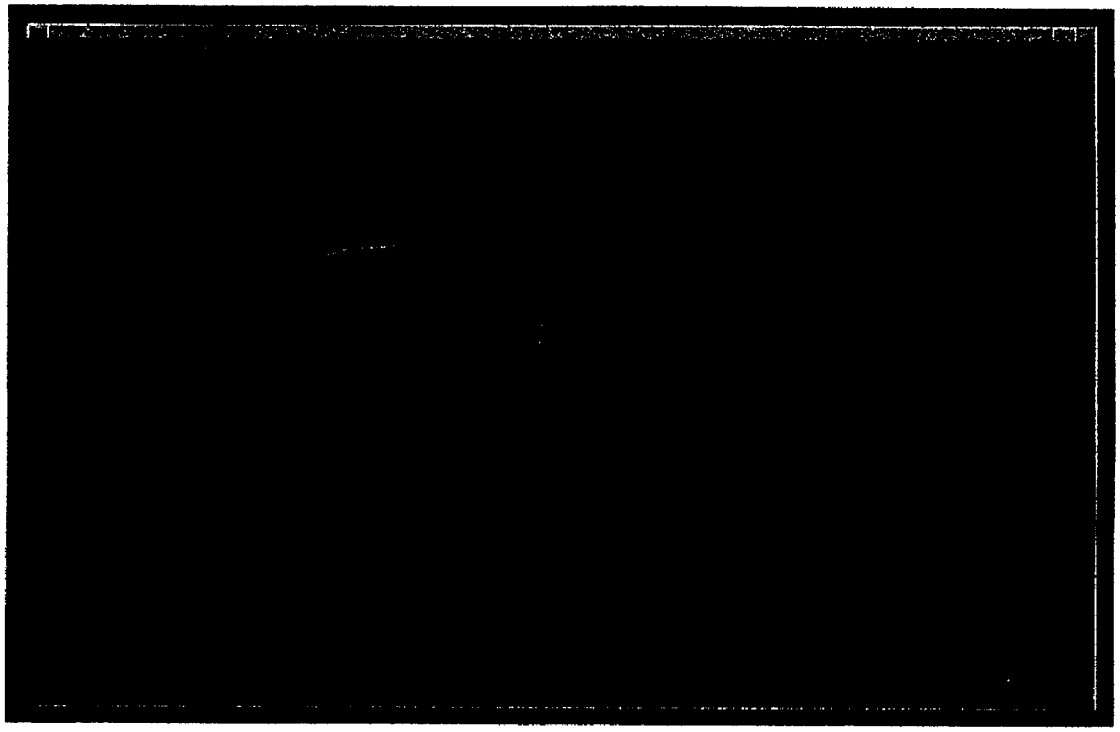
FIG. 6 is a depiction of a flat map view of a virtual target range on a display.
Figure 7:
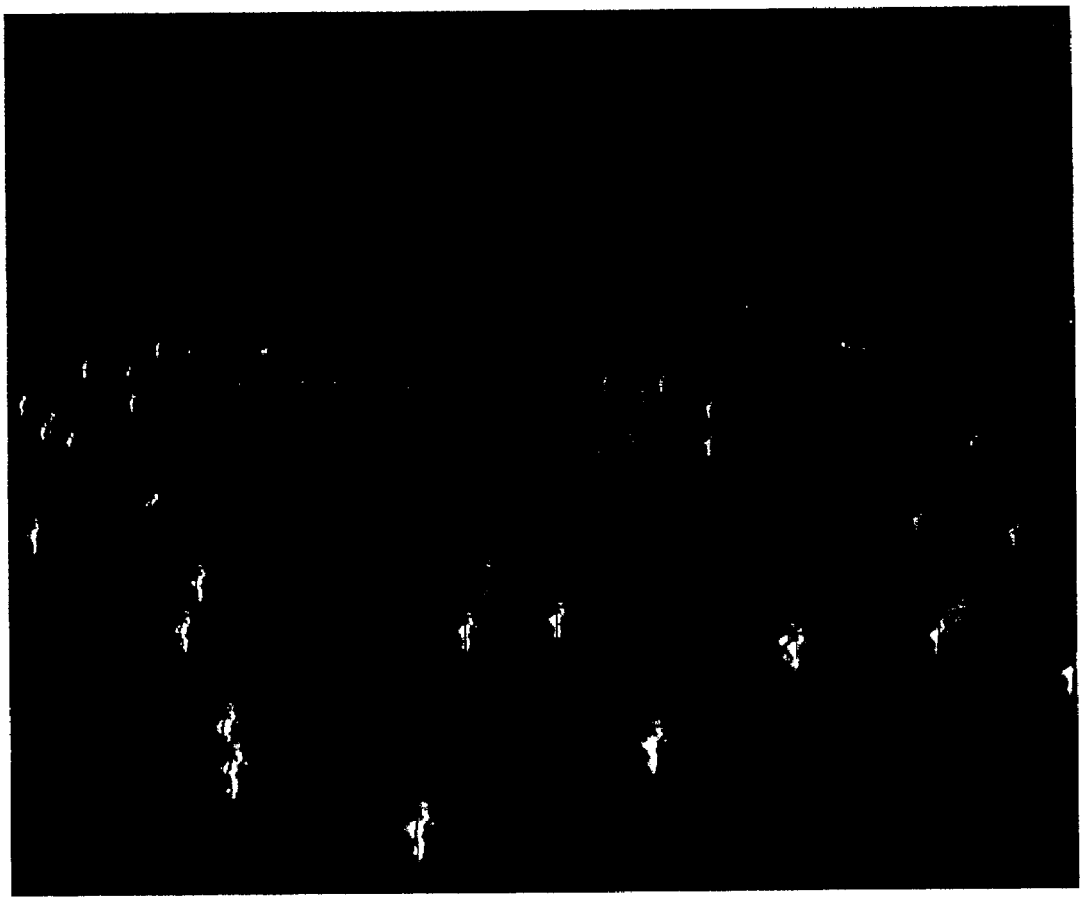
FIG. 7 is a depiction of a three-dimensional view of a virtual target range on a display.
Figure 8:
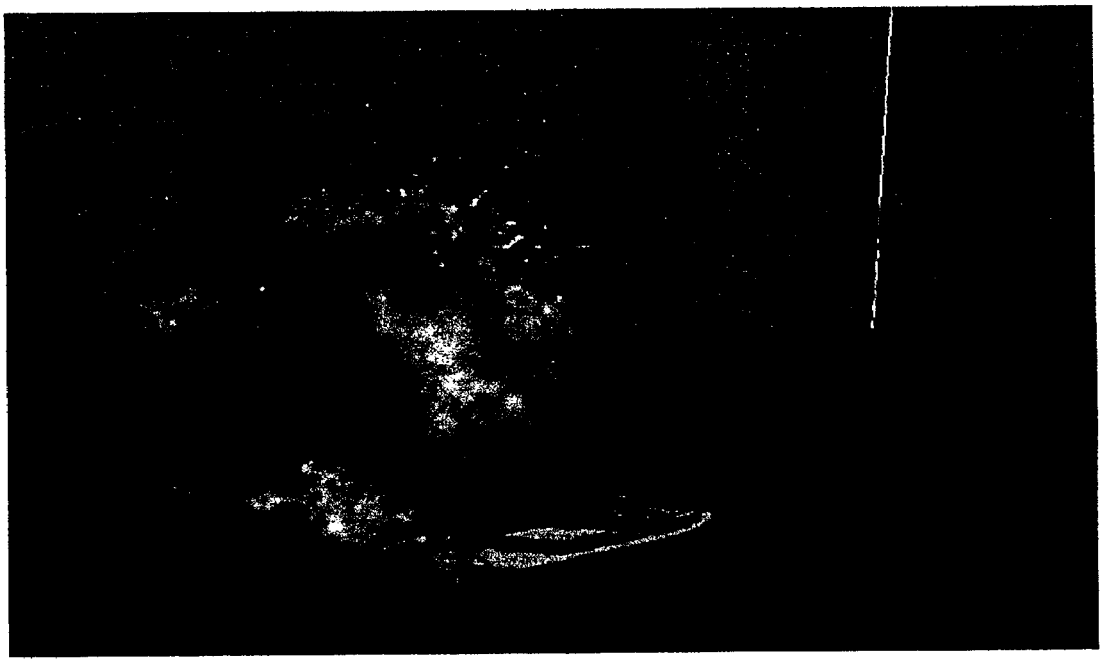
FIG. 8 is a depiction of a god's-eye view of a fire exercise.
Figure 9:
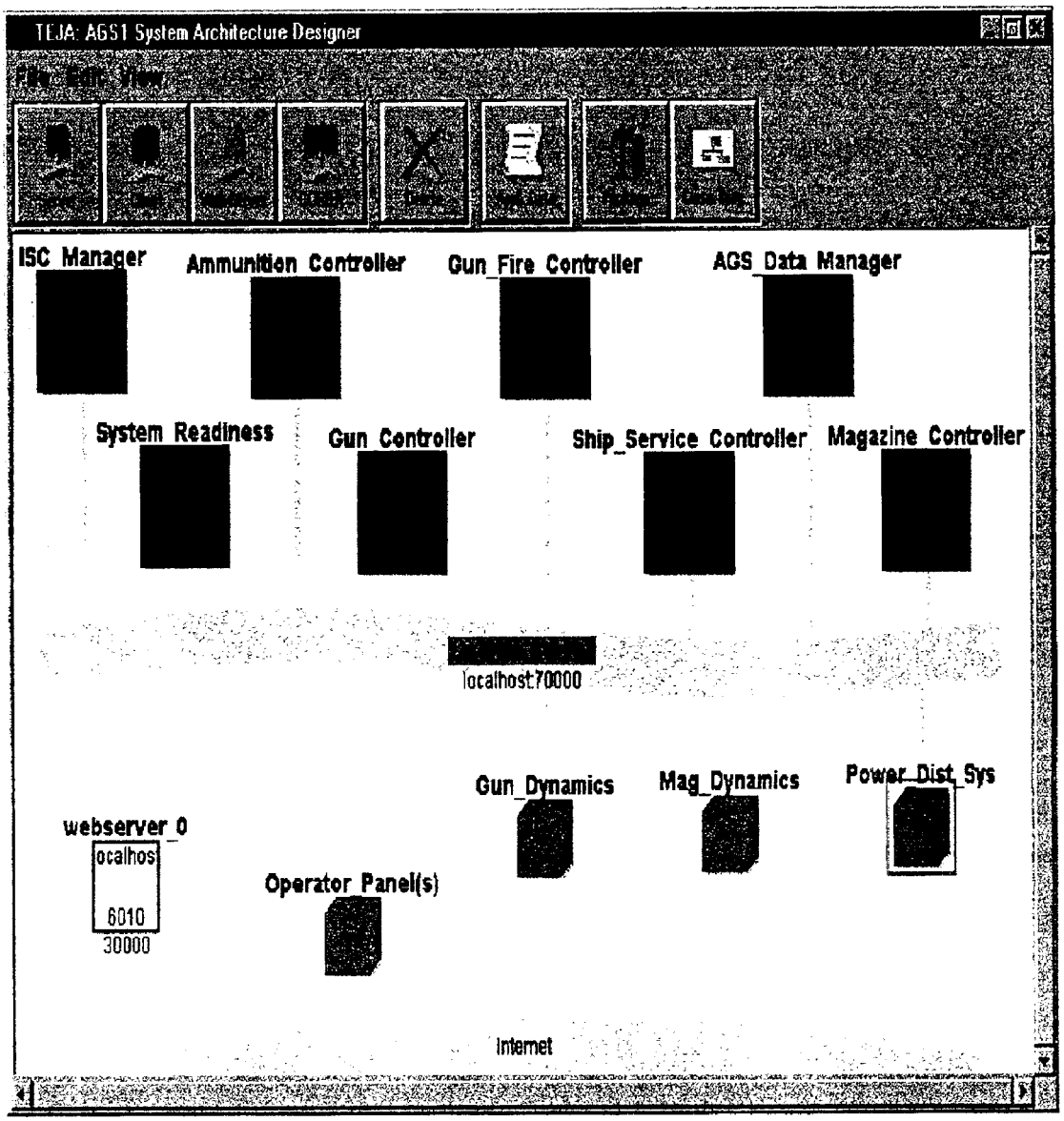
FIG. 9 is a depiction of a control panel for the target system.

The naval virtual target range system 10 extensively uses graphical user interface tools to provide more user flexibility and convenience. Several examples of panels are illustrated in FIGS. 5 through 9. FIG. 5 illustrates a generic control subsystem panel, FIG. 6 illustrates a flat map view on a control subsystem display, and FIG. 7 illustrates a three-dimensional graphical view, on a control subsystem display or a spotter subsystem display, of a virtual target range overlain with virtual impact points. The perspective of the view in FIG. 7 is dependent on the location of the subsystem on which the view is displayed, and thus can be different for the control subsystem and the spotter subsystem. FIG. 8 illustrates a god's-eye view of a fire exercise on a control subsystem display, and FIG. 9 depicts a control subsystem control panel on a control subsystem display.

The method of operating a naval virtual target range system 10 comprises providing a naval virtual target range system 10 including a control subsystem 20 operatively connected to a naval weapon system 90. The control subsystem 20 has a computer system 22 programmed for implementing a three-dimensional graphical view 24 of a naval virtual target range 26 and programmed for calculating results 32 of a naval weapon fire exercise. The control subsystem 20 also has a control subsystem display 34. Also provided is a spotter subsystem 40 operatively connected to the control subsystem 20 and having a spotter subsystem display 42. In alternative embodiments, a buoy subsystem 60, an aerial subsystem 70 including an aerial vehicle 72, or both are provided, as would be necessary for live fire exercises. As shown in the functional diagrams of FIGS. 10 and 11, the control subsystem 20 is used to implement a naval virtual target range 26, which is displayed on the spotter subsystem display 42 and the control subsystem display 34. Given the implemented naval virtual target range 26, a naval weapon system fire exercise is conducted, and data about the exercise is collected from the naval weapon system 90. When the buoy subsystem 60 is used in live fire exercises on and below the water, data from a sensor about the time it perceives an impact sound and about its global position at that moment are also provided. When the aerial vehicle 72 is used in live fire exercises above the water, data about the vehicle's global position and position orientation are provided along with video data and/or radar recordings of an impact. All this data is provided to the control subsystem 20 via direct connection or radio transmission-reception.

Figure 10:
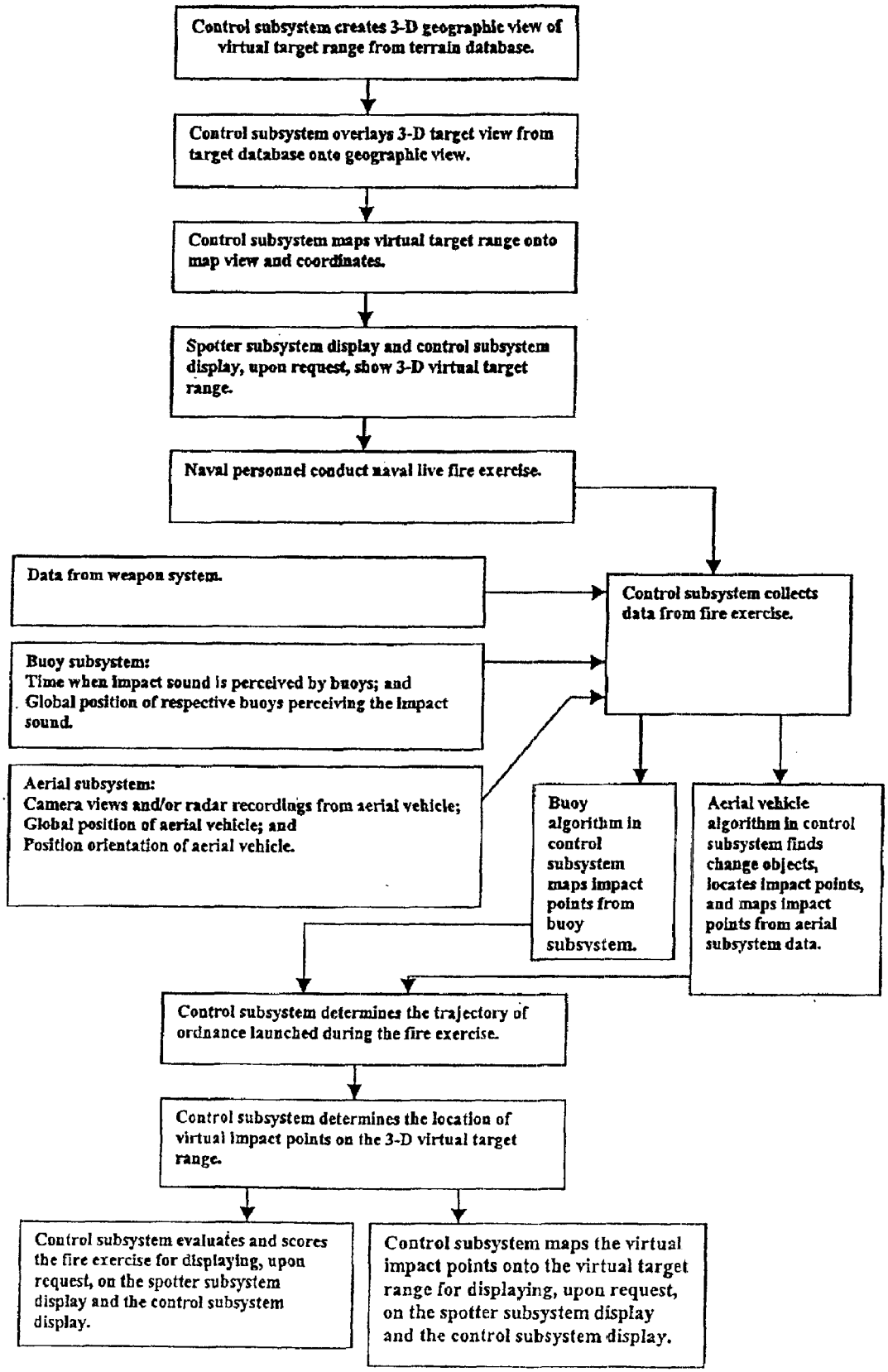
FIG. 10 is a functional flowchart of the method of operating a naval virtual target range system under live fire conditions.

With respect to live fire exercise detection, as shown in FIG. 10, the sensory subsystem data is first input into the appropriate algorithms, as discussed above, to find and map the location of the impact points. From this information, the trajectories of ordnance can be determined, usually from trajectory tables, and the virtual impact point on the virtual target range 26 can be determined, evaluated, and scored. The results of these computations can then be shown in still or animated three-dimensional form on a spotter subsystem display 42 and/or a control subsystem display 34, and because the spotter subsystem 40 and control subsystem 20 include global positioning systems, from the vantage point or location of the respective subsystems.

Figure 11:
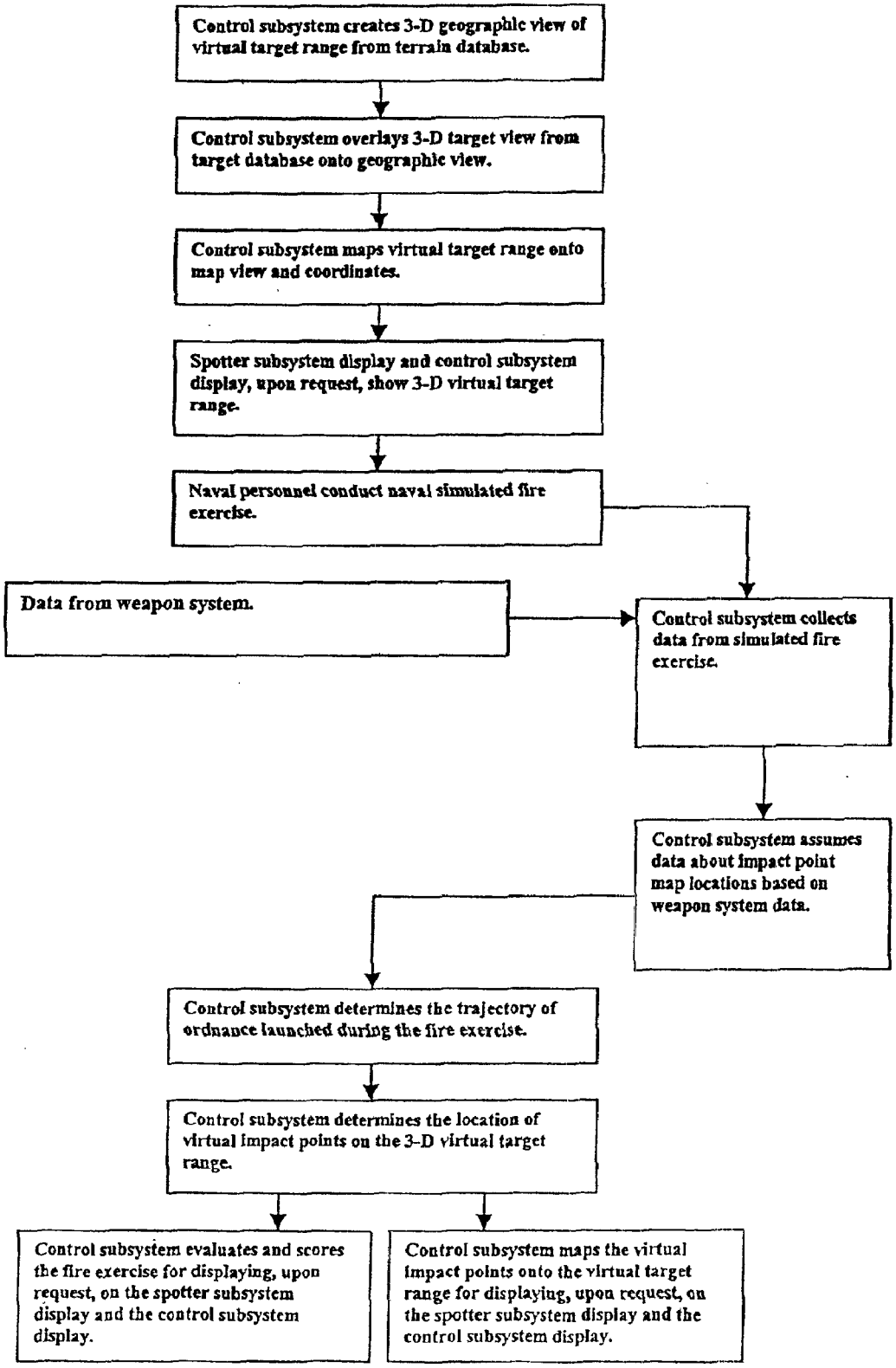
FIG. 11 is a functional flowchart of the method of operating a naval virtual target range system under simulated fire conditions.

With respect to simulated fire exercises, as shown in FIG. 11, data is provided from the naval weapon system 90, from which the impact points and trajectory of ordnance are assumed and the virtual impact points on the virtual target range 26 are determined, evaluated, and scored. The results from the simulated fire exercise can then be viewed in a manner similar to those for live fire exercises.

While the integral naval virtual target range system can be used with a wide variety of naval weapon systems, the preferred embodiment described herein is particularly adapted for use with large caliber naval guns, such as a MK45 five inch gun, a MK75 three inch gun, or guns of similar size. The system can also be adapted to other weapon systems such as that used to fire a surface attack missile.

Although the preferred embodiment of the naval virtual target range system has been described herein, it should be recognized that numerous changes and variations can be made and that the scope of the present invention is to be defined by the claims.

What is claimed is:

1. A naval virtual target range system, comprising:

a control subsystem operatively connected to a naval weapon system and having a computer system including:

means for implementing a three-dimensional graphical view of a naval virtual target range for use in conjunction with a naval weapon system fire exercise; and means for calculating results of the naval weapon system fire exercise from selective data provided by the naval weapon system; and a spotter subsystem operatively connected to the control subsystem and having a transmitter-receiver that communicates with at least one spotter sensor system, a global positioning satellite system and a spotter subsystem display for viewing three-dimensional graphic results of the naval weapon system fire exercise generated by the computer system.

2. The naval virtual target range system of claim 1, wherein the computer system further includes a terrain database storing a plurality of geographic formation implementations and a target database storing a plurality of physical object implementations, and wherein the naval virtual target range is implemented from implementations stored in the terrain database and the target database.

3. The naval virtual target range system of claim 1, wherein the sensor subsystem includes a buoy subsystem including at least three sensors, that determines impact points of the naval weapon system fire exercise relative to the buoy subsystem, and wherein the buoy subsystem is operatively connected to the control subsystem to also provide data to the control subsystem for calculating results of the naval weapon system fire exercise.

4. The naval virtual target range system of claim 3, wherein the buoy subsystem has a global positioning system and each of the at least three sensors is selected from a group of sensors consisting of radar and acoustic sensors, and wherein the buoy subsystem records the time when a sensor perceives an impact sound and the location of the sensor.

5. The naval virtual target range system of claim 1, wherein the sensor subsystem includes an aerial subsystem including an aerial vehicle having a combination of a camera system and radar, that determines pact points of the naval weapon system fire exercise relative to the aerial vehicle, and wherein the aerial vehicle is operatively connected to the control subsystem to also provide data to the control subsystem for calculating results of the naval weapon system fire exercise.

6. The naval virtual target range system of claim 5, wherein the camera system is selected from a group of camera systems consisting of a charged-coupled device camera, a digital television camera, an infrared camera, and a combination of these, wherein the radar is a millimeter-wave radar, and wherein each view point on the plane of a camera view is associated with a line segment between the view point and the center point of the camera view and with a directional number associated with the line segment.

7. The naval virtual target range system of claim 5, wherein the control subsystem detects significant changes in visual data, wherein said significant change in said visual data comprises an object, said object having an outline, said outline having a major axis that is used to find an impact point of ordnance launched during the fire exercise.

8. The naval virtual target range system of claim 1, wherein data collected from the naval fire exercise by the control subsystem is used by the control subsystem to find and map impact points of ordnance launched during the fire exercise, calculate trajectories of the ordnance from the data and the impact points, and calculate virtual impact points on the naval virtual target range from the data, the trajectories, and the naval virtual target range implementation.

9. A naval virtual target range system control subsystem operatively connected to a naval weapon system and having a computer system comprising:

a terrain database storing a plurality of geographic formation implementations;

a target database storing a plurality of physical object implementations;

means for implementing a three-dimensional graphical view of a naval virtual target range from implementations stored in the terrain database and the target database, for use in conjunction with a naval weapon system fire exercise;

means for calculating results of the naval weapon system fire exercise from selective data provided by the naval weapon system; and a spotter subsystem operatively connected to the control subsystem and having a transmitter-receiver that communicates with at least one spotter sensor system, a global positioning satellite system and a spotter subsystem display for viewing three-dimensional results of the naval weapon system fire exercise generated by the computer system.

10. The naval virtual target range system of claim 9, wherein the sensor subsystem includes a buoy subsystem including at least three sensors, that determines impact points of the naval weapon system fire exercise relative to the buoy subsystem, and wherein the buoy subsystem is operatively connected to the control subsystem to also provide data to the control subsystem for calculating results of the naval weapon system fire exercise.

11. The naval virtual target range system of claim 10, wherein the buoy subsystem has a global positioning system and each of the at least three sensors is selected from a group of sensors consisting of radar and acoustic sensors, and wherein the buoy subsystem records the time when a sensor perceives an impact sound and the location of the sensor.

12. The naval virtual target range system of claim 9, wherein the sensor subsystem includes an aerial subsystem including an aerial vehicle having a combination of a camera system and radar, that determines impact points of the naval weapon system fire exercise relative to the aerial vehicle, and wherein the aerial vehicle is operatively connected to the control subsystem to also provide data to the control subsystem for calculating results of the naval weapon system fire exercise.

13. The naval virtual target range system of 10, wherein the camera system is selected from camera systems consisting of a charged-coupled device camera, a digital television camera, an infrared camera, and a combination of these, wherein the radar is a millimeter-wave radar, and wherein each view point on the plane of a camera view is associated with a line segment between the view point and the center point of the camera view and with a directional number associated with the line segment.

14. A naval virtual target range system, comprising:

a control subsystem operatively connected to a naval weapon system and having a computer system including:

means for implementing a three-dimensional graphical view of a naval virtual target range for use in conjunction with a naval weapon system fire exercise; and means for calculating results of the naval weapon system fire exercise from selective data provided by the naval weapon system and at least three sensors;

a buoy subsystem including the at least three sensor, that determines impact points of the naval weapon system fire exercise relative to the buoy subsystem, and wherein the buoy subsystem is operatively connected to the control subsystem to provide data to the control subsystem; and a spotter subsystem operatively connected to the control subsystem and having a transmitter-receiver that communicates with at least the buoy subsystem, a global positioning satellite system and a spotter subsystem display for viewing three-dimensional results of the naval weapon system fire exercise generated by the computer system.

15. The naval virtual target range system of claim 14, wherein the computer system further includes a terrain database storing a plurality of geographic formation implementations and a target database storing a plurality of physical object implementations, and wherein the naval virtual target range is implemented from implementations stored in the terrain database and the target database.

16. The naval virtual target range system of claim 15, wherein the buoy subsystem has a global positioning system and each of the at least three sensors is selected from a group of sensors consisting of radar and acoustic sensors, and wherein the buoy subsystem records the time when a sensor perceives an impact sound and the location of the sensor.

17. A naval virtual target range system, comprising:

a control subsystem operatively connected to a naval weapon system and having a computer system including:

means for implementing a naval virtual target range for use in conjunction with a naval weapon system fire exercise; and means for calculating results of the naval weapon system fire exercise from selective data provided by the naval weapon system and combination of a camera system and radar; and an aerial vehicle including the combination of a camera system and radar, that determines the impact points of the naval weapon system fire exercise relative to the aerial vehicle, and wherein the aerial vehicle is operatively connected to the control subsystem to also provide data to the control subsystem.

18. The naval virtual target range system of claim 17, wherein the computer system further includes a terrain database storing a plurality of geographic formation implementations and a target database storing a plurality of physical object implementations, and wherein the naval virtual target range is implemented as a three-dimensional graphical view from implementations stored in the terrain database and the target database.

19. The naval virtual target range system of claim 17, further comprising a spotter subsystem operatively connected to the control subsystem and having a spotter subsystem display for viewing three-dimensional results of the naval weapon system fire exercise generated by the computer system.

20. The naval virtual target range system of claim 17, wherein the camera system is selected from a group of camera systems consisting of a charged-coupled device camera, a digital television camera, an infrared camera, and a combination of these, wherein the radar is a millimeter-wave radar, and wherein each view point on the plane of a camera view is associated with a line segment between the view point and the center point of the camera view and with a directional number associated with the line segment.

21. A method of operating a naval virtual target range system, comprising:

providing a naval virtual target range system including:

a control subsystem operatively connected to a naval weapon system and having a computer system programmed for implementing a three-dimensional graphical view of a naval virtual target range and programmed for calculating results of a naval weapon fire exercise; and a spotter subsystem operatively connected to the control subsystem and having a transmitter-receiver that communicates with at least one spotter sensor system, a global positioning satellite system and a spotter subsystem display;

using the control subsystem to implement a naval virtual target range;

displaying the naval virtual target range on the spotter subsystem display;

conducting a naval weapon system fire exercise;

providing data about the naval weapon system fire exercise from the naval weapon system to the control subsystem;

using the control subsystem to calculate results about the naval weapon system fire exercise; and displaying the results on the spotter subsystem display.

22. The method of claim 21, further comprising the steps of providing a buoy subsystem as at least part of the spotter subsystem including means for collecting data about a live naval weapon system fire exercise and providing at least some collected data to the control subsystem for calculating results of the naval weapon fire exercise.

23. The method of claim 21, further comprising the steps of providing an aerial subsystem as at least part of the spotter subsystem including means for collecting data about a live naval weapon system fire exercise and providing at least some collected data to the control subsystem for calculating results of the naval weapon fire exercise.

* * * * *

UNITED STATES PATENT AND TRADEMARK OFFICE

CERTIFICATE OF CORRECTION

PATENT NO. : 6,875,019 B2
DATED : April 5, 2005
INVENTOR(S) : Huang et al.

It is certified that error appears in the above-identified patent and that said Letters Patent is hereby corrected as shown below:

Column 1,
Line 17, delete "Modem" and insert -- Modern --.

Column 2,
Line 33, delete "Kauai" and insert -- Kuala --.

Column 9,
Line 36, delete "pact" and insert -- impact --.

Signed and Sealed this

Fifth Day of July, 2005

JON W. DUDAS
*Director of the United States Patent and Trademark Office*